US011805927B2

(12) United States Patent
Carwardine et al.

(10) Patent No.: US 11,805,927 B2
(45) Date of Patent: Nov. 7, 2023

(54) JEWELRY DISPLAY APPARATUS

(71) Applicant: MEJURI Inc., Toronto (CA)

(72) Inventors: Laura Carwardine, Toronto (CA); Adrienna Matzeg, Toronto (CA)

(73) Assignee: MEJURI Inc., Toronto (CA)

( * ) Notice: Subject to any disclaimer, the term of this patent is extended or adjusted under 35 U.S.C. 154(b) by 0 days.

(21) Appl. No.: 17/665,901

(22) Filed: Feb. 7, 2022

(65) Prior Publication Data

US 2022/0151403 A1 May 19, 2022

Related U.S. Application Data

(63) Continuation of application No. PCT/US2020/045111, filed on Aug. 6, 2020.

(60) Provisional application No. 62/883,421, filed on Aug. 6, 2019.

(51) Int. Cl.

| | |
|---|---|
| ***A47F 7/02*** | (2006.01) |
| ***A45C 11/16*** | (2006.01) |
| *A45C 11/06* | (2006.01) |

(52) U.S. Cl.

CPC ..... *A47F 7/02* (2013.01); *A45C 11/16* (2013.01)

(58) Field of Classification Search

CPC . A47F 7/02; A47F 7/022; A45C 11/16; G09F 11/23

USPC ..... 211/85.2; 206/6.1, 733, 735; 40/492

See application file for complete search history.

(56) References Cited

U.S. PATENT DOCUMENTS

| | | | | | |
|---|---|---|---|---|---|
| 366,510 | A | * | 7/1887 | Rubin | G09F 7/00 40/492 |
| 454,844 | A | * | 6/1891 | Brewerton et al. | G09F 7/00 40/492 |
| 475,937 | A | * | 5/1892 | Ethridge | G09F 7/00 116/313 |
| 485,967 | A | * | 11/1892 | Mosher et al. | G09F 7/00 40/492 |
| 922,715 | A | * | 5/1909 | Munster | G09F 1/00 40/748 |
| 1,527,704 | A | * | 2/1925 | Ray | A63D 5/04 40/492 |
| 1,528,621 | A | * | 3/1925 | Lavers | G01J 3/52 281/15.1 |
| 1,552,920 | A | * | 9/1925 | Glover | G09F 7/00 116/318 |
| 2,019,816 | A | * | 11/1935 | Hunt | B42F 17/28 116/313 |

(Continued)

FOREIGN PATENT DOCUMENTS

KR 20-0184743 Y1 6/2000

OTHER PUBLICATIONS

International Search Report issued for corresponding International Patent Application No. PCT/US2020/045111, dated Nov. 13, 2020.

*Primary Examiner* — Jennifer E. Novosad

(74) *Attorney, Agent, or Firm* — MYERS WOLIN, LLC

(57) ABSTRACT

A jewelry display apparatus comprising a plurality of arms, each arm displaying a different piece of jewelry. The arms can be closed to provide an attractive display for showing the plurality of jewelry next to each other or spread apart from each other to allow the customer to view the jewelry in isolation. The arms are joined together at a common pivot point about which the arms rotate with respect to each other.

11 Claims, 7 Drawing Sheets

(56) References Cited

U.S. PATENT DOCUMENTS 2,647,486 A * 8/1953 League ..... D03J 1/00 116/315
2,694,873 A * 11/1954 Francis, Jr. ..... A45B 27/00 40/492
3,315,634 A * 4/1967 Sherrill ..... G09F 17/00 116/315
3,418,737 A * 12/1968 Lambert ..... G09F 19/00 351/158
4,070,775 A * 1/1978 Brooks ..... B60Q 7/005 116/319
4,104,809 A * 8/1978 Day ..... G09F 5/04 281/15.1
4,911,287 A * 3/1990 Speers ..... B65D 73/00 211/85.2
4,920,675 A * 5/1990 Mashimo ..... G09F 7/10 283/56
5,240,120 A * 8/1993 McDonough ..... A47F 7/02 211/85.2
5,283,920 A * 2/1994 Plummer ..... A01K 97/00 7/106
5,358,280 A * 10/1994 Scales ..... B42B 5/08 283/37
5,664,669 A * 9/1997 VanFleet ..... A47F 5/0006 211/113
6,014,942 A * 1/2000 Perka ..... G09F 17/00 116/319
6,056,130 A * 5/2000 Ovadia ..... A47F 7/02 211/85.2
6,474,693 B1 * 11/2002 Nitsche ..... G09F 11/06 40/538
6,665,965 B1 * 12/2003 Turchi ..... G09F 5/04 434/98
6,913,144 B1 * 7/2005 Todd ..... G09F 5/00 206/388
7,284,557 B1 * 10/2007 Williams ..... A45D 24/00 7/168
7,353,736 B2 * 4/2008 Poehlmann ..... B25F 1/003 7/128
7,458,457 B2 * 12/2008 Hiller ..... A47F 7/02 294/170
D688,310 S * 8/2013 Mauris ..... D20/18
8,746,471 B2 * 6/2014 Hiller ..... A47F 7/02 211/85.2
9,009,999 B2 * 4/2015 Hill ..... G09F 11/00 40/495
D752,289 S * 3/2016 Tegtmeyer ..... D28/56
2005/0194334 A1 * 9/2005 Johnson ..... A45D 8/36 211/85.2
2005/0194337 A1 9/2005 McDaniel
2006/0131187 A1 6/2006 Hiller et al.
2010/0300900 A1 12/2010 Quan
2013/0032556 A1 2/2013 Hiller et al.
2022/0151403 A1 * 5/2022 Carwardine ..... A45C 11/16

* cited by examiner

JEWELRY DISPLAY APPARATUS

CROSS-REFERENCE TO RELATED APPLICATIONS

This application is a continuation under 35 U.S.C. § 120 of International Application PCT/US2020/045111, filed Aug. 6, 2020, which claims priority to U.S. Provisional Application Ser. No. 62/883,421, filed Aug. 6, 2019, the entire contents of each of which are herein incorporated by reference in their entirety.

FIELD OF THE INVENTION

The present invention discloses a jewelry display apparatus for holding a plurality of jewelry pieces that allows customers to view the jewelry on their person (e.g., ear, hand, etc.) before purchase.

BACKGROUND

Many different display devices and methods currently exist for showing and trying on jewelry. At most stores, jewelry is displayed on a display case or a viewing rack, and the customer inspects each piece of jewelry one piece at a time. A customer is usually allowed to try on certain types of jewelry, such as rings or bracelets. However, other types of jewelry, such as earrings, cannot be tried on due to sanitary and liability reasons. Therefore, a customer purchasing earrings can, at most, hold one piece to their ear at a time to see how the earring would appear on their ear, and their hand often obfuscates the view. Therefore, a need clearly exists for a jewelry display apparatus in which a customer can simultaneously inspect multiples pieces of jewelry while inspecting them individually to see how they would appear on their person.

SUMMARY

Disclosed herein is a jewelry display apparatus comprising a plurality of arms, each arm displaying a different piece of jewelry. The arms are arranged such that they can be closed to provide an attractive display for showing the plurality of jewelry next to each other or spread apart from each other to allow the customer to view the jewelry in isolation. The arms are preferably joined together at a common pivot point about which the arms rotate with respect to each other.

DETAILED DESCRIPTION

Figure 1:
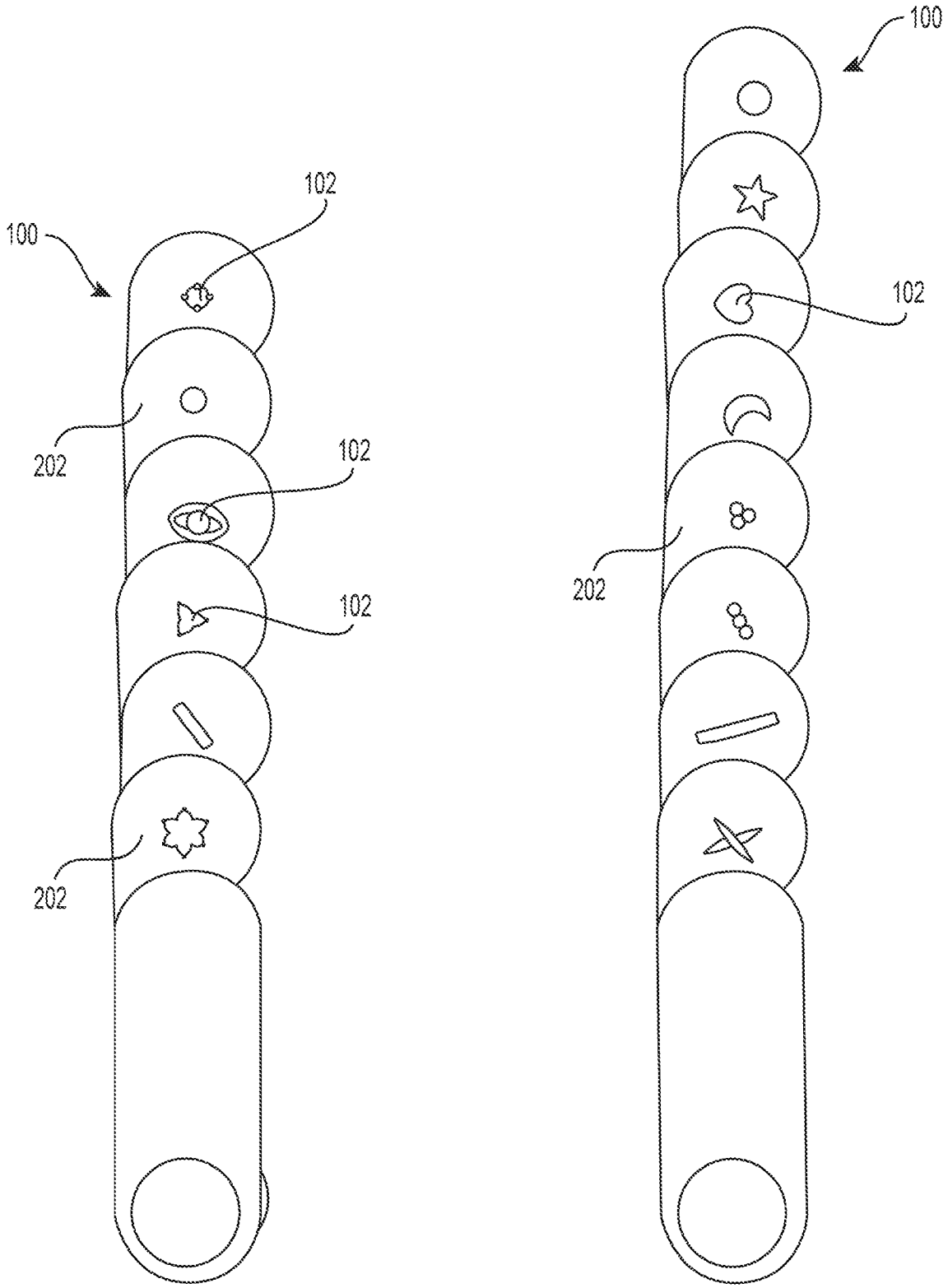
FIG. 1 depicts a front view of the jewelry display apparatus in a closed position.

Referring first to FIG. 1, depicted is a front view of two different jewelry display apparatuses 100 in a closed position. Each jewelry display apparatus 100 comprises a plurality of jewelry 102, such as earrings, mounted to the front surface of jewelry display apparatus 100 through a hole in each arm 202. As can be seen, jewelry display apparatus 100 is modular and pieces can be added/removed from jewelry display apparatus as needed or it can be made larger/smaller to accommodate more/less jewelry 102. For example, the left jewelry display apparatus 100 displays six pieces of jewelry 102 simultaneously whereas the right jewelry display apparatus 100 displays eight pieces of jewelry 102 simultaneously.

Figure 2:
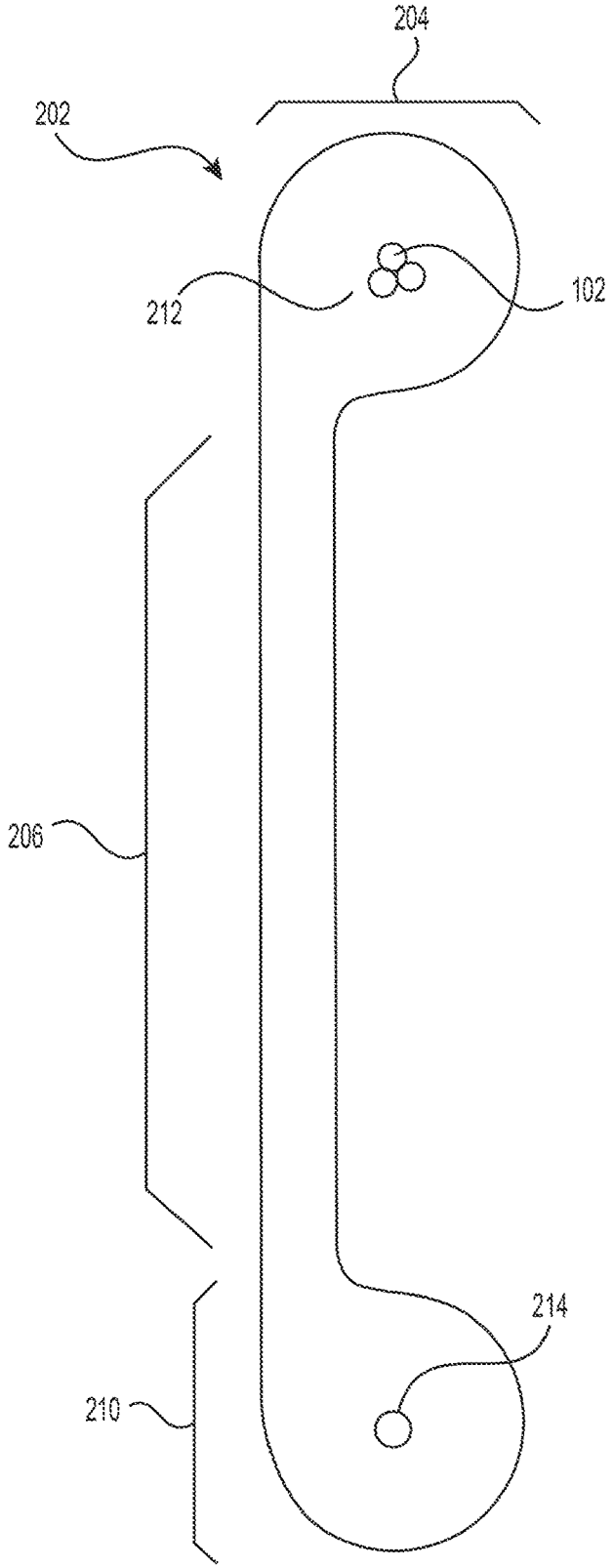
FIG. 2 depicts a view of an arm of the jewelry display apparatus in isolation.

FIG. 2 depicts a single arm 202 shown in isolation. Each arm comprises head 204, stem 206, and base 210. The head 204 has a through hole 212 for mounting a piece of jewelry 202. In the example of an earring, a stem of the earring is inserted through the hole 212 and the back is attached to hold the earring in place on arm 202. The earring can also be removed by reversing the process.

The base 210 also has a through hole 214 used for connecting a plurality of arms 202 to each other as will be described later. In a preferred embodiment, head 204 and base 210 have a similar shape, making each arm 202 symmetrical. In the depicted embodiment, the combination of the head 204 and stem 206 resembles that of the head of a musical note.

However, the shape of the head 204 and base 210 is not limited to the depicted embodiment. For example, the shape may be square, rectangular, oval, cloud shaped, etc. The shape of head 204 and base 210 can also be different from each other. As will be obvious from the description of the operation of jewelry display apparatus 100, a main requirement for the shape of head 204 and base 210 is that it is wider than stem 206 and is compact enough to allow various arms 202 to overlap so that the jewelry 102 can be displayed when jewelry display apparatus 100 is in the closed position as depicted in FIG. 1.

Figure 3:
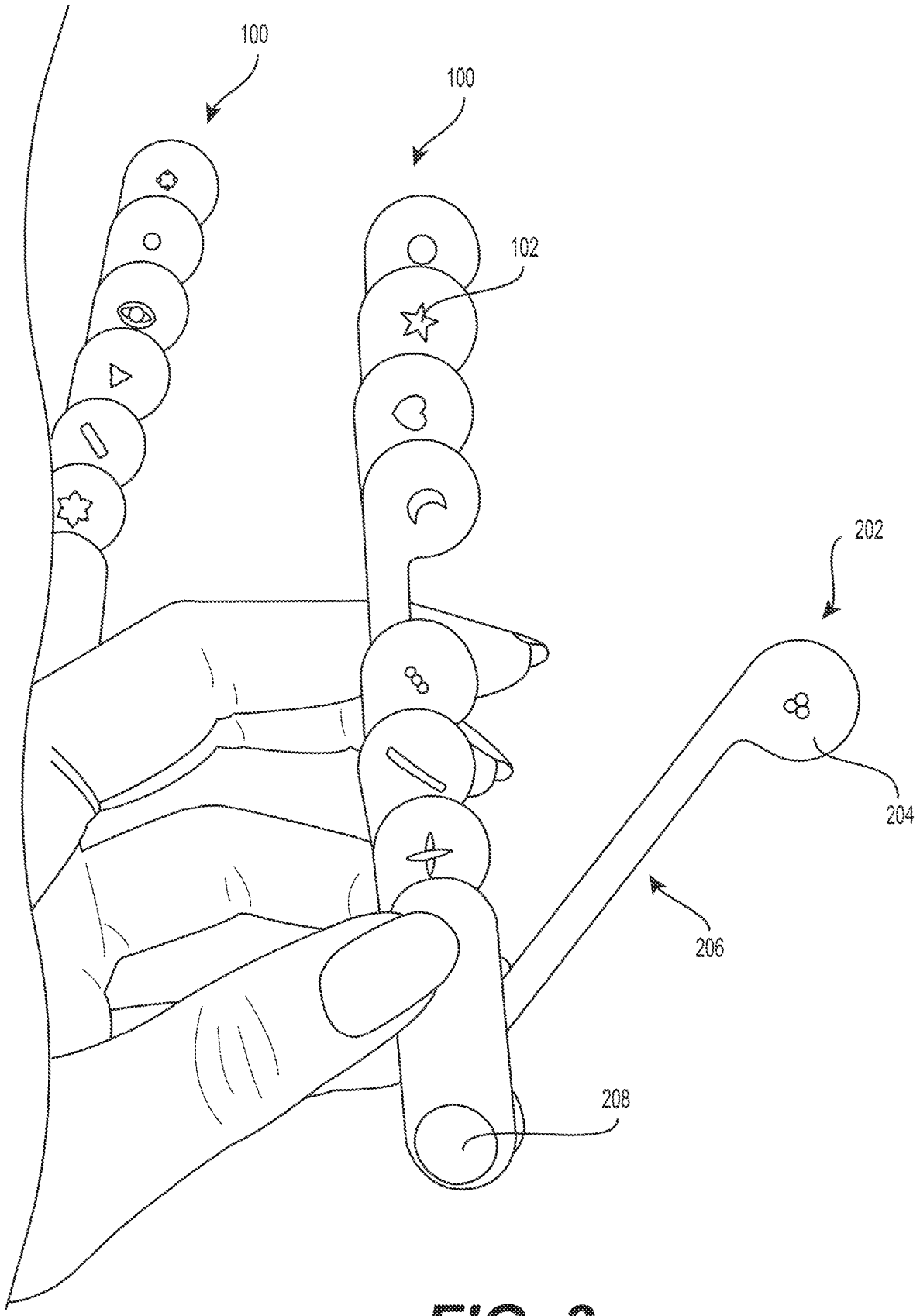
FIG. 3 depicts a view of the jewelry display apparatus with a single arm pivoted.

FIG. 3 depicts a single arm 202 pivoted away from jewelry display apparatus 100. In this depicted example, a Chicago screw 208 is inserted through each hole 210 in arms 202 to join them together and is secured on a rear side of jewelry display apparatus 100. This allows each arm 202 to independently rotate with hole 214/Chicago screw 208 as the center of rotation. This allows arms 202 to be pivoted to view jewelry 102 either together or individually. Further, since Chicago screw 208 is removable, arms 202 can be added or removed from jewelry display apparatus 100 as needed by simply unscrewing Chicago screw 208 and then reattaching. For example, with respect to FIG. 1, the jewelry display apparatus 100 shown on the right can be transformed to the jewelry display apparatus 100 on the left by removing the two longest arms 202.

As previously described, head 204 is preferably semicircular in shape with one flat side such that a side of stem 206 and head 204 merge into each other, creating a shape similar to a musical note. Head 204 and stem 206 are preferably integrally formed from a hard colored or transparent plastic material, cardboard, or metal. It should be apparent that other shapes can be used for head 204 such as oval, square, rectangular, etc. as long as jewelry display apparatus retains the ability to be fanned and closed as depicted in the figures. Further, in some embodiments, arm 102 may be made of a thicker plastic or provided with a backing material in instances where the jewelry is larger and/or heavier than earrings.

The front or rear of each stem 206 may comprise text which describes the jewelry 102 on head 204. For example, the text may be a name of the piece/collection of the jewelry 102, the brand name, the store name, a logo, or a brief description. This allows the customer to see the name/price/description of each piece of jewelry 102 as it is fanned away from jewelry display apparatus 100.

Figure 4:
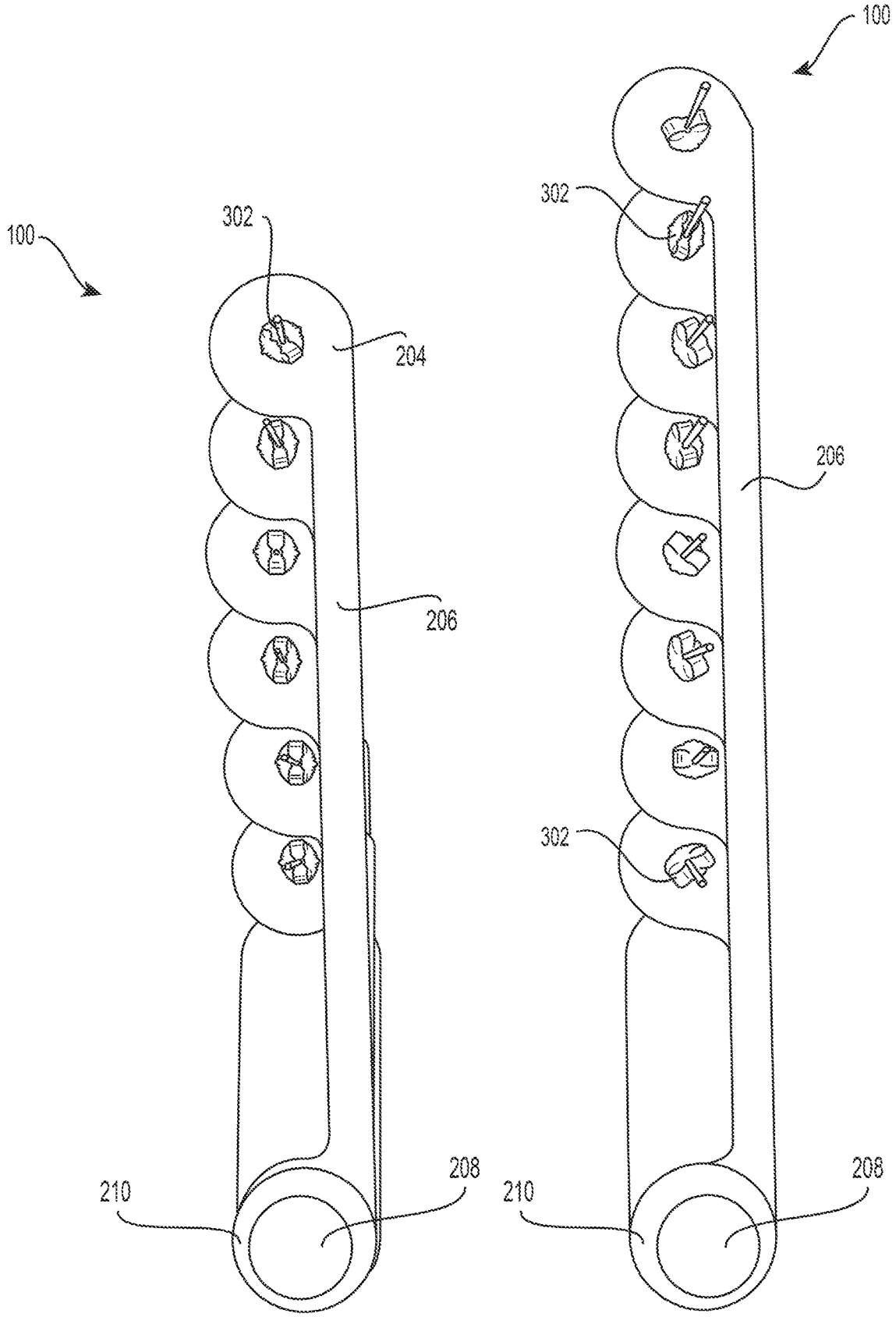
FIGS. 4-5 depicts a rear view of the jewelry display apparatus in the closed position.

FIG. 4 depicts a rear view of jewelry display apparatus 100 which shows how arms 202 nest together when jewelry display apparatus 100 is in the closed position. As previously described, the front of jewelry display apparatus shows off the front of jewelry 102 without allowing a user to be distracted by the distracting and often unornamented backing, such as the clutch of the earring which engages the earring post. For example, as depicted in FIG. 4, the earring post is inserted through a hole 212 near a center of head 204 and is secured by clutches 302 on a rear side of head 204. The offset of jewelry 102 from the edge of stem 206 allows all of the stems 206 to align when jewelry display apparatus 100 is in the closed position. This also causes all of the jewelry 102 to align linearly which creates a pleasing ordered appearance to the customer. In another embodiment, the jewelry 102 may be permanently attached to the head 204 by adhesive or any other retaining means.

This is because the size and shape of head 204 (and length of stems 206) allows all of the clutches 302 of jewelry 102 to not interfere with the opening and closing of jewelry display apparatus 100. It should be obvious to one of ordinary sill in the art that the offset of jewelry 102 from stems 206, the length of stems 206, as well as the size and shape of heads 204 are chosen based on the type of jewelry 102 to be displayed using jewelry display apparatus 100. For example, stud earrings, such as those depicted in the drawings, require much smaller heads 204 than those that would be required for displaying broaches or other larger forms of jewelry 102 (e.g., hoop earrings). The length of each stem 206 for each arm 202 is sized such that each head 202 slightly overlaps with adjacent heads 202 as shown, but not a center portion of head 202 so that jewelry 102 can be displayed without interference.

As previously discussed, bases 210 are preferably identical to the shape of heads 204 as shown in FIGS. 2 and 4, making the arms 202 symmetrical. This allows the Chicago screw 208 to exert more pressure over a greater surface area of bases 210 when tightened. A customer can easily adjust the force required to pivot or move arms 202 by loosening or tightening Chicago screw 208. For example, once a customer has pivoted the arms 202 containing the desired jewelry 102, the customer could tighten Chicago screw 208 to hold those selected arms 202 away from the other non-selected arms 202. It should be obvious to one of ordinary skill in the art that other types of connection methods can be used instead of Chicago screw 208 as long as they can be placed through holes 214 and can secure arms 202 together such that they can be rotated with respect to each other.

Figure 5:
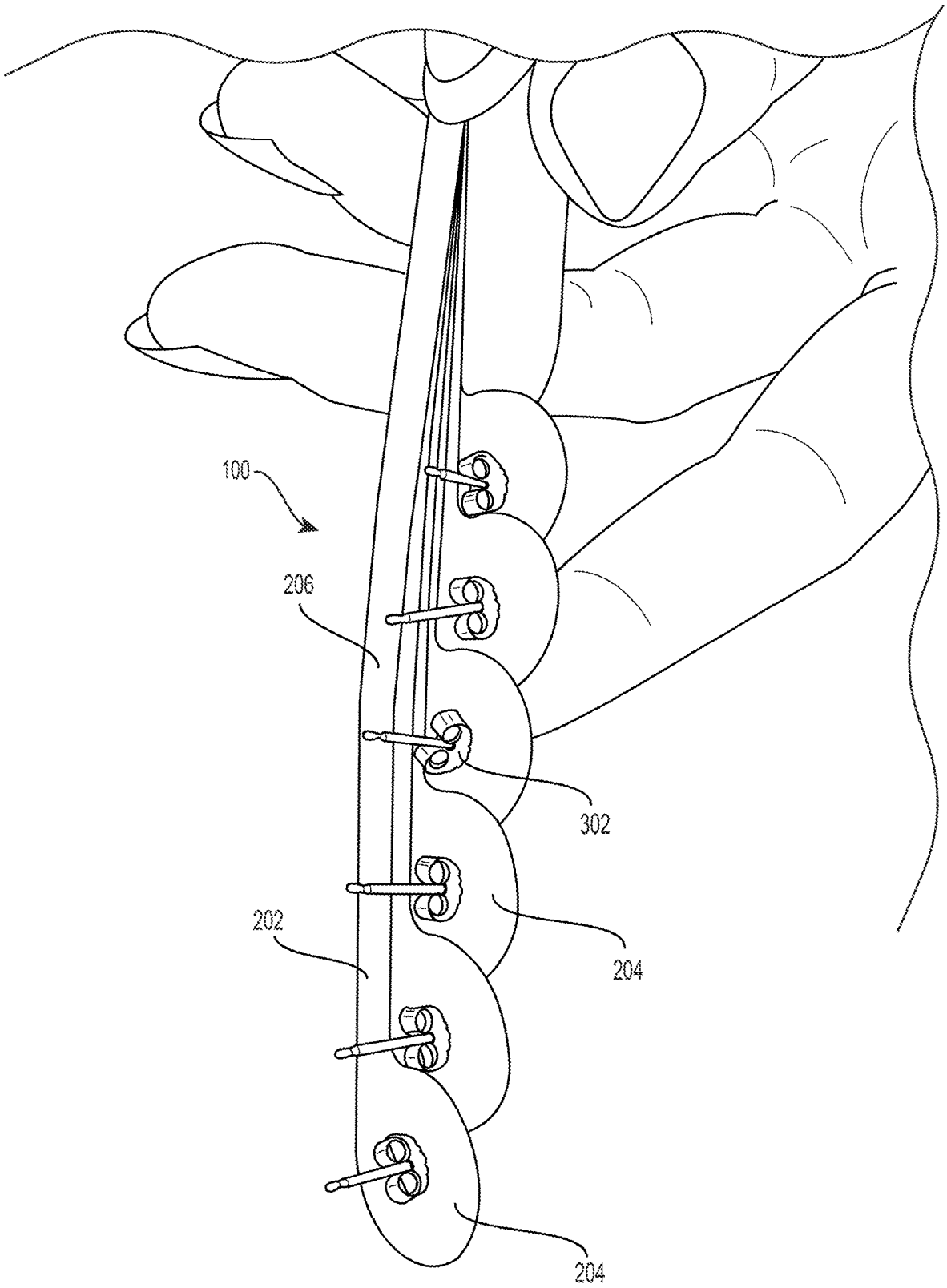

FIG. 5 better depicts the nesting characteristics of jewelry display apparatus 100 when in the closed position. As shown, each stem 206 has the same width but a varied length. Compared to the width and length of the stems 206, the thickness is much reduced, allowing multiple arms 202 to be stacked (e.g., six shown in FIG. 5) without making the overall thickness of jewelry display apparatus unwieldly. In fact, as shown, the clasp of a single earring is much greater than the combined thickness of arms 202.

The thickness of bases 210 also allows the jewelry display apparatus 100 to be held by a customer without it slipping out of their hand. This view also depicts how the rear posts of the jewelry 102 also help to prevent the jewelry display apparatus 100 form being closed past the depicted position because of their interference.

Figure 6:
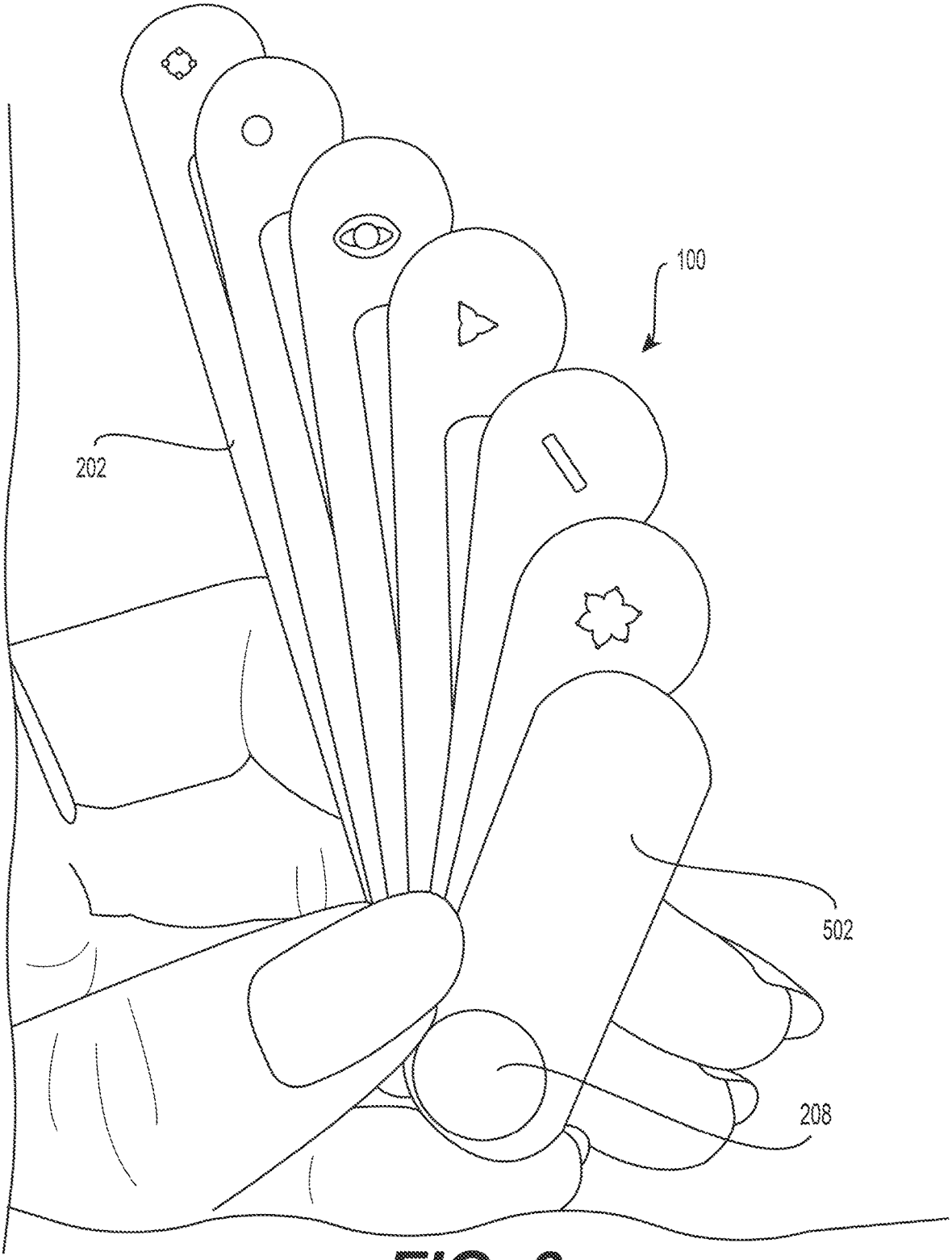
FIG. 6 depicts the arms of the jewelry display apparatus in a fanned configuration.

FIG. 6 depicts arms 202 in a fanned configuration. Jewelry display apparatus 100 may further comprise cover piece 502 which has an overall thickness of heads 204 along its entire length. Cover piece 502 may be provided in order to cover the lower portions of stems 206 so that jewelry display apparatus 100 has a more uniform length and width (without inconsistencies) when in the closed position as depicted in FIG. 1. Cover piece 502 may also contain text, for example, identifying a jewelry collection, store name, etc.

Figure 7:
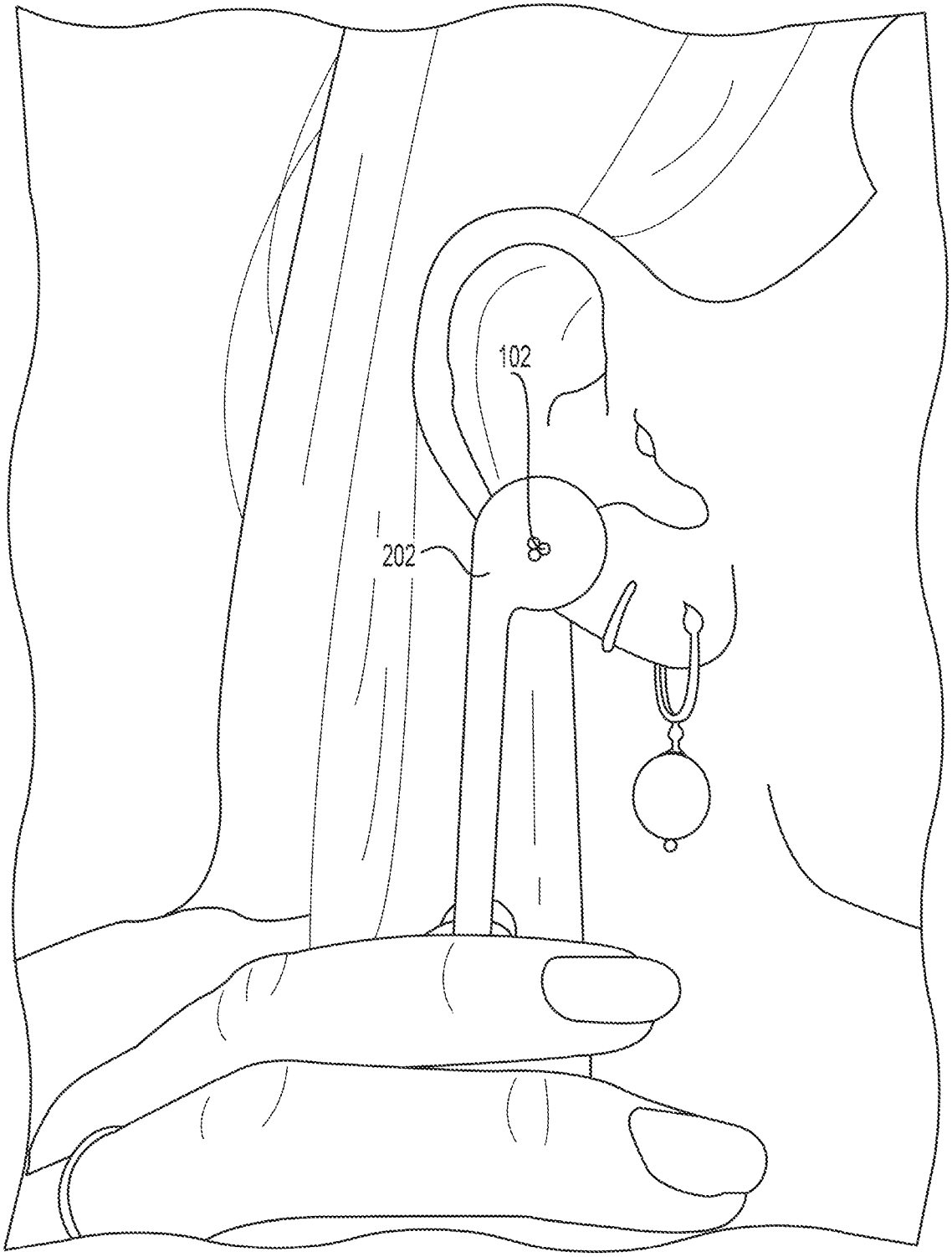
FIG. 7 depicts a customer holding a single arm of the jewelry display apparatus to the ear.

FIG. 7 depicts an example of the use of jewelry display apparatus 100 by a customer in a commercial setting. Once a customer has selected a specific piece of jewelry 102 on a particular arm 202, the user can pivot the selected arm 202 (e.g. 180°) away from the other arms 202 to view jewelry 102 in isolation. The customer can then hold the jewelry 102 up to their ear or other body part to see how the jewelry 102 would appear on the customer when worn as depicted in FIG. 7. For example, if arm 202 is made from a clear plastic material in FIG. 7, the customer can more easily see how the earring would appear on their ear in contrast to if the user were to hold their hand with the earring up to their ear, obfuscating part of their ear.

Thus, through the user of jewelry display apparatus 100 a user can quickly "try on" a plurality of jewelry 102 without physically having to insert the earring through the ear. This is more hygienic for both the store owner and the customer. This can also help to reduce theft for the store owner because the customer is never in possession of the jewelry 102 by itself. Also, if a user attempts to remove a piece of jewelry 102 from jewelry display apparatus 100, it is very clear to the store owner that the jewelry is missing because a missing piece on jewelry display apparatus 100 can be quickly noticed at a glance.

In a similar manner to that depicted in FIG. 7, a user can also hold jewelry display apparatus 100 against different parts of the body where no piercings currently exist to see how the piercing would appear at the location. For example, if the customer is considering a naval piercing, they could hold the jewelry 102 in the vicinity of their navel. Or, the user could hold the jewelry 102 near a part of the ear not currently pierced.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the invention in diverse forms thereof. Any one or more features or functions of the first/other aspects/embodiments disclosed above may also be incorporated into the second/present aspect/embodiment, alone or in any combination.

The invention claimed is:

1. A jewelry display apparatus comprising:

a plurality of arms, each arm comprising:

a head, wherein the head has a first hole in a center of the head;

a base, wherein the base has a second hole in a center of the base; and a stem connecting the head to the base, wherein a width of the head and a width of the base are both greater than a width of the stem, wherein a length of the stem is greater than a length of the head and a length of the base and a removable connector passed through the second hole of each of the plurality of arms to secure them together, wherein each arm is freely rotated with respect to each other with the connector as a center of rotation, and wherein a shape and a size of the head and the base are the same.

2. The jewelry display apparatus according to claim 1, wherein the head and the base are semi-circular.

3. The jewelry display apparatus according to claim 2, further comprising:

a plurality of earrings, wherein, for each arm of the plurality of arms, a stem of an earring from the plurality of earrings is passed through the first hole and is secured to the arm using a clasp of the earring.

4. The jewelry display apparatus according to claim 3, wherein the plurality of arms are formed from a flexible plastic.

5. The jewelry display apparatus according to claim 3, wherein the plurality of arms are formed from a transparent plastic.

6. The jewelry display apparatus according to claim 1, wherein the connector is a Chicago screw.

7. The jewelry display apparatus according to claim 1, wherein, when the jewelry display apparatus is in a closed position, the stem of each of the plurality of arms is aligned.

8. A jewelry display apparatus comprising:

a plurality of arms, each arm comprising:

a head, wherein the head has a first hole in a center of the head;

a base, wherein the base has a second hole in a center of the base and a stem connecting the head to the base, wherein a width of the head and a width of the base are both greater than a width of the stem wherein a length of the stem is greater than a length of the head and a length of the base and a removable connector passed through the second hole of each of the plurality of arms to secure them together, wherein each arm is freely rotated with respect to each other with the connector as a center of rotation, and wherein a shape and a size of the head and the base are the same, wherein a cover piece placed in front of the plurality of arms and secured to the jewelry display apparatus by the connector, wherein the cover piece has a width the same as the width of the head of each of the plurality of arms, and wherein the cover piece has a length less than each arm of the plurality of arms.

9. The jewelry display apparatus according to claim 8, further comprising:

a plurality of earrings, wherein, for each arm of the plurality of arms, a stem of an earring from the plurality of earrings is passed through the first hole and is secured to the arm using a clasp of the earring.

10. The jewelry display apparatus according to claim 8, wherein the plurality of arms are formed from a flexible plastic.

11. The jewelry display apparatus according to claim 8, wherein the plurality of arms are formed from a transparent plastic.

* * * * *